US010799033B2

(12) United States Patent
Hall et al.

(10) Patent No.: US 10,799,033 B2
(45) Date of Patent: Oct. 13, 2020

(54) WATERBED SYSTEM

(71) Applicant: Hall Flotation LLC, Tamarac, FL (US)

(72) Inventors: Charlie Hall, Bainbridge Island, WA (US); Michael Geraghty, Lawndale, CA (US)

(73) Assignee: Hall Flotation LLC, Tamarac, FL (US)

( * ) Notice: Subject to any disclaimer, the term of this patent is extended or adjusted under 35 U.S.C. 154(b) by 0 days.

(21) Appl. No.: 16/693,665

(22) Filed: Nov. 25, 2019

(65) Prior Publication Data

US 2020/0085203 A1 Mar. 19, 2020

Related U.S. Application Data

(62) Division of application No. 15/902,915, filed on Feb. 22, 2018.

(51) Int. Cl.

| | |
|---|---|
| ***A47C 27/08*** | (2006.01) |
| ***A47C 31/00*** | (2006.01) |
| ***A47C 27/16*** | (2006.01) |
| ***A47C 27/00*** | (2006.01) |

(52) U.S. Cl.

CPC ..... *A47C 27/085* (2013.01); *A47C 27/002* (2013.01); *A47C 27/16* (2013.01); *A47C 31/00* (2013.01)

(58) Field of Classification Search

CPC ..... A47C 27/00; A47C 27/08; A47C 27/085; A47C 27/086

See application file for complete search history.

(56) References Cited

U.S. PATENT DOCUMENTS

| | | | | | |
|---|---|---|---|---|---|
| 2,462,524 | A * | 2/1949 | Mattedi | A47C 17/86 | 5/308 |
| 3,745,596 | A * | 7/1973 | Copeland | A47C 17/86 | 5/308 |
| 3,855,655 | A * | 12/1974 | Propst | A47C 21/00 | 5/488 |
| 4,073,019 | A * | 2/1978 | Fraser | A47C 27/085 | 5/679 |
| 4,110,854 | A * | 9/1978 | Sjolie | A47C 27/085 | 5/2.1 |
| 4,186,452 | A * | 2/1980 | Underwood | A47C 19/005 | 5/400 |

(Continued)

*Primary Examiner* — Peter M. Cuomo
*Assistant Examiner* — Ifeolu A Adeboyejo
(74) *Attorney, Agent, or Firm* — Jeffrey G. Sheldon; Katherine B. Sales; Cislo & Thomas LLP

(57) ABSTRACT

A waterbed system for placement on a ground surface can comprise one or more of the following components: a waterbed mattress, a foam structure around the periphery of the mattress, a platform below the mattress and the foam periphery for supporting the waterbed mattress and the foam structure, a foundation coupled to and extending downwardly from the platform, preferably a single, fire resistant polyester fiber baffle disposed within the waterbed mattress, a cover over the top surface of the mattress and around the outer surface of the foam structure, a water proof liner below the bottom surface of the mattress, a water bed heater under the liner between the liner and the upper surface of the platform, a layer of fiberglass insulation attached to the lower surface of the platform, and an accessory storage container coupled to the foundation.

8 Claims, 4 Drawing Sheets

(56) References Cited

U.S. PATENT DOCUMENTS

| | | | | | |
|---|---|---|---|---|---|
| 4,259,755 | A * | 4/1981 | Hollander | A47C 13/005 | 312/111 |
| 4,807,315 | A * | 2/1989 | Wachenheim | A47C 27/085 | 109/23 |
| 5,056,342 | A * | 10/1991 | Prinz | A47C 21/00 | 109/51 |
| 5,099,529 | A * | 3/1992 | Anderson | A47C 19/04 | 5/201 |
| 5,317,888 | A * | 6/1994 | Towns | A47C 17/86 | 109/51 |
| 5,329,865 | A * | 7/1994 | McWard | A47B 46/005 | 108/93 |
| 5,687,435 | A * | 11/1997 | Dufresne | A47C 17/86 | 312/235.2 |
| 5,713,650 | A * | 2/1998 | King | A47B 81/00 | 312/265.4 |
| 6,148,459 | A * | 11/2000 | Verhulst | A47C 21/00 | 248/311.2 |
| 6,292,960 | B1 * | 9/2001 | Bowling | A47C 17/86 | 5/308 |
| 6,347,419 | B1 * | 2/2002 | Kurtz | A47C 21/00 | 206/373 |
| 6,651,797 | B1 * | 11/2003 | Tree | G07F 9/06 | 194/215 |
| 7,055,724 | B2 * | 6/2006 | Farentinos | B60R 9/00 | 224/403 |
| 8,479,331 | B2 * | 7/2013 | Craighead | F41C 33/041 | 5/503.1 |
| 2004/0016055 | A1 * | 1/2004 | Lamy | A47G 9/02 | 5/485 |
| 2010/0043139 | A1 * | 2/2010 | Bonatz | A47C 19/205 | 5/9.1 |

* cited by examiner

WATERBED SYSTEM

CROSS-REFERENCE TO RELATED APPLICATIONS

This application is a divisional of U.S. Non-Provisional patent application Ser. No. 15/902,915, titled "A Waterbed System," filed Feb. 22, 2018, the contents of which are incorporated by reference herein.

BACKGROUND

Although waterbeds enjoyed wide popularity due to a coinventor of the present invention, Charles Hall. Charles Hall is recognized as the "father" of the modern-day waterbed. See for example, U.S. Pat. No. 3,585,356. Waterbeds have lost market penetration. It is time to reinvent the waterbed to improve consumer acceptance. And that is what we have done.

SUMMARY

In a first embodiment, the present invention is directed to a waterbed system for placement on a ground surface, the waterbed system comprising a) a waterbed mattress having a periphery, a bottom surface, a top surface, a top surface length of from about 80 inches to about 90 inches, a top surface width of from about 30 inches to about 80 inches, and when filled with water a height of from about 6 inches to about 10 inches, b) a foam structure around the periphery of the mattress, the foam structure having an outer surface, an inner surface, and a top surface, the inner surface sloping inwardly from top to bottom, and the top surface of the foam structure be substantially flush with the top surface of the mattress when the mattress is filled with water, and wherein the foam structure is covered with a water vapor permeable cover made of flashspun high-density polyethylene fibers, c) a platform below the mattress and the foam periphery for supporting the waterbed mattress and the foam structure, the platform having an upper surface and a lower surface, d) a foundation coupled to and extending downwardly from the platform, the lower surface spaced apart from the ground surface, e) single, fire resistant polyester fiber baffle disposed within the waterbed mattress, the baffle having a length of about 70 inches to about 90 inches, a width of about 30 inches to about 80 inches, a thickness of about 5 inches to about 6 inches, and a density of about 5 denier to about 45 denier, f) a cover over the top surface of the mattress and around the outer surface of the foam structure, g) a water proof liner below the bottom surface of the mattress, around the periphery of the mattress, over the inner and upper surfaces of the foam structure, and around the outer surface of the foam structure, h) a water bed heater under the liner, between the liner and the upper surface of the platform, i) a layer of fiberglass insulation attached to the lower surface of the platform, and j) an accessory storage container coupled to the foundation, the accessory container containing at least one accessory for use with the waterbed mattress.

The system can further comprise a layer of memory foam between the top surface of the waterbed mattress and the cover.

In a second embodiment, the present invention is directed to a waterbed system for placement on a ground surface, the waterbed system comprising a) a platform having an upper surface for supporting a waterbed mattress and a lower surface, b) a foundation below the lower surface of the platform and supporting the platform for maintaining the platform spaced apart from the ground surface, and c) an accessory storage container coupled to the foundation, the accessory container containing at least one accessory for use with the waterbed mattress.

Optionally, the accessory container contains as one or more accessories, one or more of a hose connector, a venturi pump for draining the mattress, an air extractor, and water conditioner. The accessory container can comprise a door openable and closable for access to the accessories. The accessory container is removably coupled so that it can removed without tools.

Optionally, the foundation is coupled to the platform.

Optionally, the system further comprises d) a waterbed mattress having a periphery, a bottom surface, a top surface, and a top surface, e) a single, drainable fire resistant polyester fiber baffle disposed within the waterbed mattress, and f) a layer of insulation attached to the lower surface of the platform.

In a third embodiment, the present invention is directed to a kit for assembling a waterbed system for placement on a ground surface, the kit comprising a) at least one waterbed mattress having a periphery, a bottom surface, and a top surface, b) a foam structure for placement around the periphery of the mattress, the foam structure having an outer surface, an inner surface, and a top surface, the inner surface sloping inwardly from top to bottom, and wherein the foam structure is covered with a water vapor permeable cover made of flashspun high-density polyethylene fibers, c) a platform for placement below the mattress and the foam periphery for supporting the waterbed mattress and the foam structure, the platform having an upper surface and a lower surface, d) a foundation for placement below the lower surface of the platform and supporting the platform for maintaining the platform spaced apart from the ground surface, e) a single, fire resistant polyester fiber baffle disposed within the waterbed mattress, the baffle having a length of about 70 inches to about 90 inches, a width of about 30 inches to about 80 inches, a thickness of about 5 inches to about 6 inches, and a density of about 5 denier to about 45 denier, f) a cover for placement over the top surface of the mattress and around the outer surface of the foam structure, g) a water proof liner for placement below the bottom surface of the mattress, around the periphery of the mattress, over the inner and upper surfaces of the foam structure, and around the outer surface of the foam structure, h) a water bed heater for placement between the liner and the upper surface of the platform, i) a layer of fiberglass insulation for attachment to the lower surface of the platform or attached to the lower surface of the platform, and j) an accessory storage container coupled to or for coupling to the foundation of the platform, the accessory container containing one or more accessories for use with the waterbed mattress.

The kit can further comprise a cover for placement over the top surface of the mattress and around the outer surface of the foam structure.

The kit can further comprise a layer of memory foam for placement above the top surface of the waterbed mattress. Optionally, the accessory container contains as one or more accessories, one or more of a hose connector, a venturi pump for draining the mattress, an air extractor, and water conditioner. The accessory container comprises a door openable and closable for access to the accessories. The accessory container is removably coupled so that it can removed without tools.

In a fourth embodiment, the present invention is directed to a carrier for a waterbed mattress comprising a) a sheet of flexible material having a maximum length of from about 30 inches to about 50 inches and a longitudinal axis, and a maximum width of from about 30 inches to about 50 inches, opposed end edges and opposed side edges, b) a first set of handles attached to the flexible material, the first set comprising a handle extending from each of the side edges and opposed to each other, and c) a second set of handles attached to the flexible material, the second set comprising a handle extending from each of the side edges and opposed to each other, wherein the first set of handles and the second set of handles are laterally spaced apart from each other.

In a fifth embodiment, the present invention is directed to a waterbed system for placement on a ground surface, the waterbed system comprising a) a waterbed mattress having a periphery, a bottom surface, a top surface, and a top surface, b) a foam structure around the periphery of the mattress, c) a platform below the mattress and the foam periphery for supporting the waterbed mattress and the foam structure, the platform having a lower surface, d) a foundation below the lower surface of the platform and supporting the platform for maintaining the platform spaced apart from the ground surface, e) a single, fire resistant polyester fiber baffle disposed within the waterbed mattress, f) a water proof liner below the bottom surface of the mattress, around the periphery of the mattress, over the inner and upper surfaces of the foam structure, and around the outside outer surface of the foam structure, and g) a layer of fiberglass insulation attached to the lower surface of the platform.

The system can further comprise a layer of memory foam above the top surface of the waterbed mattress, and the foam structure can be covered with a water vapor permeable cover made of flashspun high-density polyethylene fibers.

The cover can be stretched in all directions by at least 10% and no more than 110%. Optionally, the cover is made from at least 70% polyester fiber and between about 5% and 30% synthetic fiber.

In a sixth embodiment, the present invention is directed to a kit for assembling a waterbed system for placement on a ground surface, the kit comprising a) a waterbed mattress having a periphery, a bottom surface, a top surface, and a top surface, b) a foam structure for placement around the periphery of the mattress, c) a platform for placement below the mattress and the foam periphery for supporting the waterbed mattress and the foam structure, the platform having a lower surface, d) a foundation for placement below the lower surface of the platform and supporting the platform for maintaining the platform spaced apart from the ground surface, e) a single, fire resistant polyester fiber baffle disposed within the waterbed mattress, f) a water proof liner for placement below the bottom surface of the mattress, around the periphery of the mattress, over the inner and upper surfaces of the foam structure, and around the outside outer surface of the foam structure, and g) a layer of fiberglass insulation for attachment to the lower surface of the platform.

Optionally, the kit comprises two waterbed mattresses.

In a seventh embodiment, the present invention is directed to a method for moving a waterbed mattress, the method comprising the steps of i) draining substantially all water contained in the waterbed mattress from the waterbed mattress, ii) folding the drained waterbed mattress, iii) placing the folded waterbed mattress on the carrier of claim 13 for a waterbed mattress; and iv) moving the carrier and the folded waterbed mattress contained therein.

In an eighth embodiment, the present invention is directed to a waterbed system for placement on a ground surface, the waterbed system comprising a) a platform having an upper surface for supporting a waterbed mattress and a lower surface, b) a foundation below the lower surface of the platform and supporting the platform for maintaining the platform spaced apart from the ground surface, c) a waterbed mattress having a periphery, a bottom surface, a top surface, and a top surface, and d) a single, drainable fire resistant polyester fiber baffle disposed within the waterbed mattress.

Optionally, the system further comprises a layer of insulation attached to the lower surface of the platform.

In a ninth embodiment, the present invention is directed to a waterbed system for placement on a ground surface, the waterbed system comprising a) a platform having an upper surface for supporting a waterbed mattress and a lower surface, b) a foundation below the lower surface of the platform and supporting the platform for maintaining the platform spaced apart from the ground surface, and c) a layer of insulation attached to the lower surface of the platform.

Optionally, the layer of insulation is made from fiberglass.

DRAWINGS

These and other features, aspects, and advantages of the present invention will become better understood with reference to the following description, appended claims, and accompanying drawings where:

DESCRIPTION

As used herein, the following terms and variations thereof have the meanings given below, unless a different meaning is clearly intended by the contest in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

Figure 1:
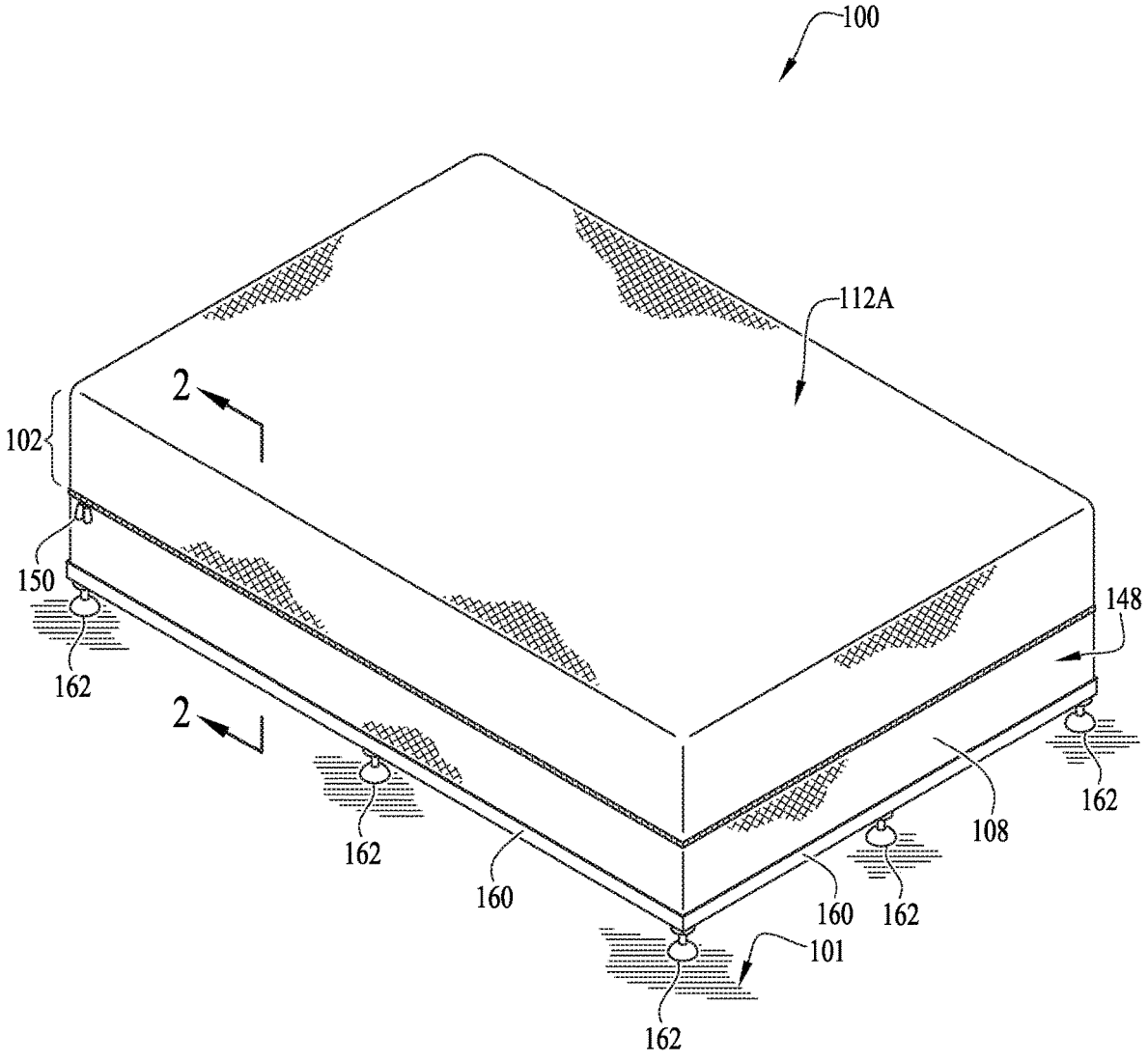
FIG. 1 is a perspective view of a waterbed system having features of the present invention.
Figures 2, 2A:
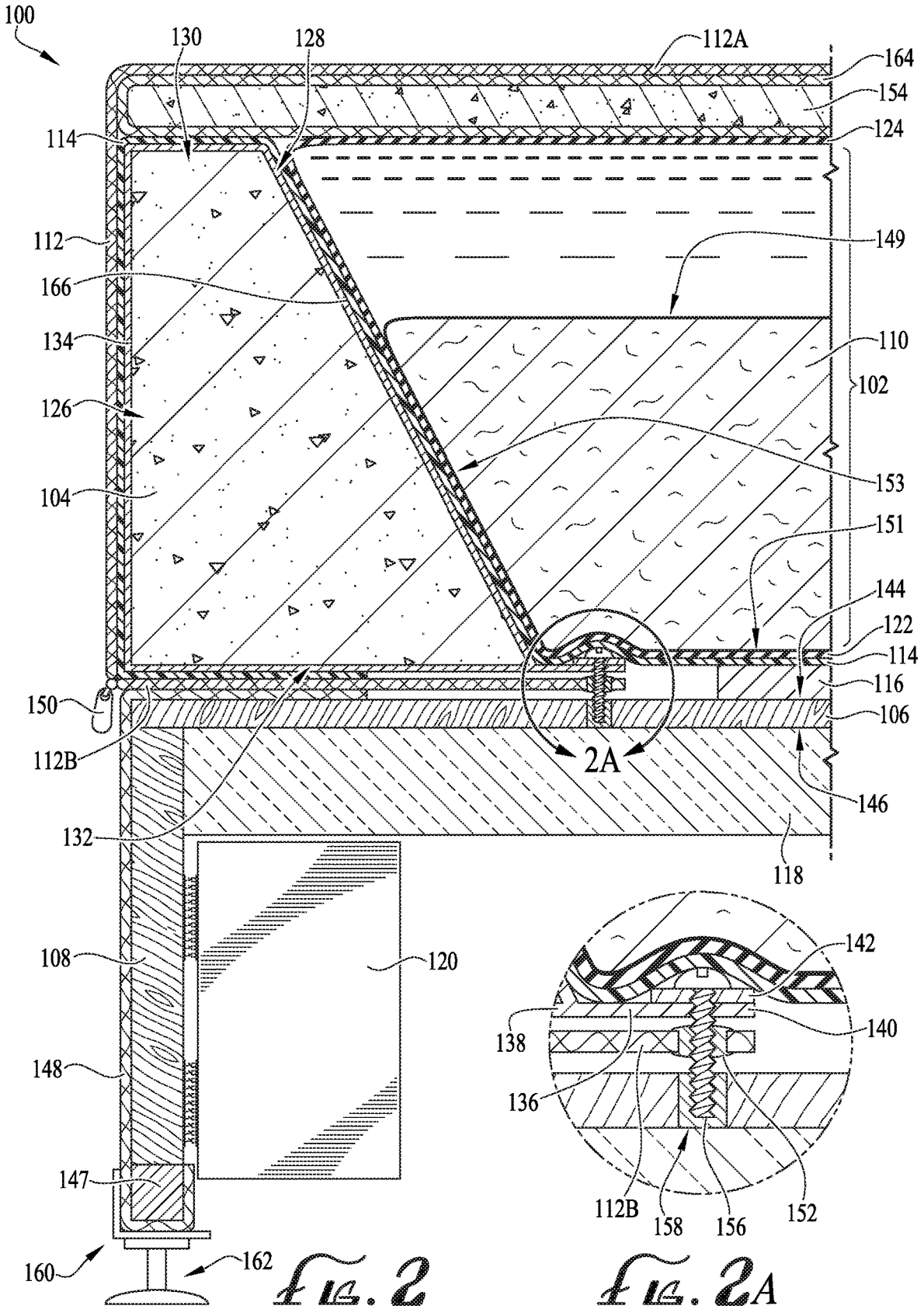
FIG. 2 is a sectional view of the waterbed system of FIG. 1, taken along line 2-2 in FIG. 1.
FIG. 2A is a blown up view of region 2A in FIG. 2

Referring now to FIGS. 1 and 2, there is shown a waterbed system 100 for placement on a ground surface 101. The waterbed system 100 comprises a waterbed mattress 102, a foam structure 104 around the periphery 105 of the mattress, a platform 106 below the mattress 102 and the foam structure 104 for supporting the waterbed mattress 102 and the foam structure 104, a foundation 108 coupled to and extending downwardly from the platform 106, a single, fire resistant polyester fiber baffle 110 disposed within the waterbed mattress 102, a cover 112 over the mattress 102 and around the foam structure 104, a water proof liner 114 below the mattress 102, a water bed heater 116 under the liner 114, a layer of insulation 118 below the platform 106, and an accessory storage container 120 coupled to the foundation 108. Optionally the invention comprises a kit for assembling the waterbed system 100 for placement on the ground surface.

There can be multiple laterally spaced apart baffles.

The waterbed mattress 102 has a bottom surface 122, a top surface 124, and four side surfaces 166. The side surfaces 166 of the mattress 102 are angled inwardly from top to bottom. The top surface 124 typically has a length of from about 70 inches to about 90 inches and typically a width of from about 30 inches to about 80 inches. The bottom surface 122 of the mattress 102 typically has a length of from about 70 inches to about inches 90 and a width of from about 30 inches to about 80 inches. Typically, the bottom surface 122 width and length are about 4 inches less than the corresponding width and length of top surface 124 dimensions due to the inwardly angled side surfaces 166. When the mattress 102 is filled with water the mattress 102 typically has a height of from about 6 inches to about 10 inches. The term "filled with water" means the mattress 102 is filled to an amount that the top surface 124 of the mattress 102 is about at the top surface 130 of the foam structure 104.

Optionally, the system 100 can comprise two separate waterbed mattresses 102 that are side by side on the platform 106, for example, if the system 100 is a king or queen size. If two people are sleeping in the same bed, each may desire a different temperature, and having two separate waterbed mattresses 102 allows that. In the event there are two mattresses 102, there can be a foam divider that runs the length of the mattresses 102 between the mattresses 102. This acts as insulation to enable each mattress to maintain its own separate temperature. Additionally, having two separate mattresses 102 reduces the amount of movement one person feels when the other moves. Two separate heaters can be used where there are two mattresses, one for each mattress.

The foam structure 104 has an outer surface 126, an inner surface 128, a top surface 130 and a bottom surface 132. The inner surface 128 slopes inwardly from top to bottom, and when the foam structure 104 is installed on the platform 106 and mattress 102 is filled with water, the top surface 130 of the foam structure 104 is substantially flush with the top surface 124 of the mattress 102. This provides a comfortable transition from the top surface 130 of the foam structure 104 to the top of the mattress 102. The foam structure 104 extends around the periphery of the platform 106 in order to provide side support to the waterbed mattress 102. As such, the foam structure 104 typically comprises four separate pieces (one along each end of the platform 106 and one along each side of the platform 106). However, the foam structure 104 can comprise a single square shaped piece with an open center for placement of the waterbed mattress 102 therein. In either event, the foam structure 104 can have mitered interior corners that fit together.

In addition to providing support for the mattress 102, the downward force of the foam structure 104 provides the added benefit of securing the bed sheets on the waterbed mattress 102 better than on a traditional inner spring or foam mattress. This is due to the fact that the sheets used on this system 100 extend down the outside surface 126 of the foam structure 104 and tuck under the bottom surface 132 of the foam structure 104, securing the edges of the sheets between the bottom surface 132 of the foam structure 104 and the upper surface of the platform 106.

Preferably the corners of the foam structure 104 are mitered, so the outer surface 126 of the foam structure 104 is rectangle shaped and the inner, top, and bottom surfaces 128, 130, 132 of the foam structure 104 are isosceles trapezoid shaped. As such, the outside and inside edges of the inner, top, and bottom surfaces 128, 130, 132 of the foam structure 104 have different measurements. Typically, the outside edges of these surfaces 128, 130, 132 are longer than the inside edges, and the lengths of all the surfaces 126, 128, 130, 132 of the four pieces of the foam structure 104 can vary depending on the size of the platform 106.

With respect to the outer surface 126 of the foam structure 104, and its rectangular shape, the outer surface 126 has a length of from about 70 inches to about 90 inches and a width of from about 5 inches to about 12 inches.

With respect to the inner surface 128 of the foam structure 104, the outside edge can have a length of from about 30 inches to about 90 inches, and the inside edge can have a length of from about 18 inches to about 78 inches. The inner surface 128 can have a width of from about 5 inches to about 12 inches.

With respect to the top surface 130 of the foam structure 104, the outside edge can have a length of about 30 inches to about 90 inches and the inside edge can have a length of from about 26 inches to about 86 inches. The top surface 130 can have a width of from about 1 inch to about 6 inches, but preferably the top surface 130 has a width of about 2 inches.

With respect to the bottom surface 132 of the foam structure 104, the outside edge can have a length of from about 30 inches to about 90 inches and the inside edge can have a length of from about 18 inches to about 78 inches. The bottom surface 132 can have a width of from about 1 inch to about 12 inches, but preferably the bottom surface 132 has a width of about 6 inches.

The foam structure 104 is covered with a water vapor permeable cover 134 made of flashspun high-density polyethylene fibers. For example, the material of the cover 134 is sold under the trade name Tyvek® by DuPont. The foam structure cover 134 has a flap 136 that extends off the corner formed at the meeting of the inner and bottom surfaces 128, 132 of the foam structure 104. The flap 136 has a proximate edge 138 coupled to the foam structure cover 134 and a distal edge 140, wherein the distal edge 140 is coupled to a slat 142. The flap 136 has a width of from about 2 inches to about 12 inches, and due to the mitered corners of the foam structure 104, is typically isosceles trapezoid shaped. As such, the length of the proximate edge of the flap 136 is longer than the length of the distal edge 140 of the flap 134. Typically, the proximate edge 138 of the flap 136 has the same length as the length of the inside edges of the inner and bottom surfaces 128, 132, which is from about 18 inches to about 78 inches.

The slat 142 can be made from a metal material, a plastic material or wood. Preferably the slat 142 is made from wood. The slat 142 is typically also isosceles trapezoid shaped due to the mitered corners of the foam structure 104, and therefore an inside edge of the slat 142 is shorter than an outside edge of the slat 142. The slat 142 extends along the full length of the flap 134 and therefore the length varies depending on the length of the flap 134. The slat 142 can either be the same width as the flap 134, or it can have a width smaller than that of the flap 134. Typically, the slat 142 has a width of from about 2 inches to about 12 inches, and a thickness of from about ¼ inch to about 1 inch. Preferably the slat 142 is ½ inch thick.

The platform 106 supports the waterbed mattress 102 and the foam structure 104. The platform 106 has an upper surface 144 and a lower surface 146 and the dimensions of the platform 106 vary depending on the size of the bed (full, queen, king, California king.). Typically, the platform 106 has a length of from about 70 inches to about 90 inches, a width of from about 30 inches to about 80 inches, and a thickness of from about ½ inch to about 1 inch. The platform 106 can be made from plastic, metal or wood, but preferably the platform 106 is made from wood. Optionally, the system 100 can comprise two platforms 106, mounted side by side one or more foundations 108.

The foundation 108 is coupled to the lower surface 146 of the platform 106 and extends downwardly from the platform 106. The lower surface 146 of the platform 106 is spaced apart from the ground surface. The foundation 106 can either be formed from four solid pieces of material (one piece running along each of the four peripheral edges of the platform 106), or the foundation 108 can comprise a plurality of individual pieces coupled to and extending downward from the platform 106. In the event the foundation 108 comprises four solid pieces of material, each piece can have a width of from about 8 inches to about 12 inches, a thickness of from about ½ inch to about 1 inch, and a length commensurate to the length of the platform 106.

In the event the foundation 108 comprises a plurality of individual pieces spaced apart from each other and extending downward from the platform 106, the ends of the plurality of individual pieces not coupled to the platform 106 are coupled to each other by a length of wood 147 that runs the length of the applicable peripheral edge of the platform 106 (not shown). Each individual piece can have a length of from about 8 inches to about 12 inches, and a width of from about 1 inch to about 6 inches, and thickness of from about ½ inch to about 1 inch. Optionally, the foundation 108 can comprise a typical wood pedestal foundation under the platform 106.

Optionally the foundation 108 can comprise a foundation cover 148 that covers an outer surface of the foundation 108 and extends up and over the upper surface 144 of the platform 106 for approximately 3 inches. The foundation cover 148 can be made from the same material as the mattress cover 112, which can be a woven material, or non-woven material, and can be elastic, or non-elastic. The foundation cover 148 is coupled to the foundation 108 and the platform 106 by a fastener such as adhesive, screws, nails, or staples. The approximately 3 inch extension of the foundation cover 148 over the upper surface 144 of the platform 106 provides a smooth surface for the user to tuck the sheets of the bed in between.

A single, fiber baffle 110, preferably made of fiberglass, is disposed within the waterbed mattress 102 and has a top surface 149, a bottom surface 151, and four side surfaces 153. A preferred polyester baffle material is sold under the trade name Richfibe® by Carpenter Company, having a place of business in Richmond, Va. The baffle 110 can be fire resistant. Due to the inwardly angled inner surface 128 of the foam structure 104, it is preferable for the side surfaces 153 of the baffle 110 to also be angled inwardly, from top to bottom, by an angle of from about 105 degrees to about 135 degrees relative to perpendicular to the ground. The angling of the side surfaces of the baffle 110 helps reduce the chance of movement of the baffle 110 inside the mattress 102.

Due to the angled side surfaces 153, the top surface 149 of the baffle 110 has a length that is longer than the length of the bottom surface 151 of the baffle 110. Typically, the top and bottom surfaces 149, 151 of the baffle 110 have a length of from about 70 inches to about 90 inches and a width of from about 30 inches to about 80 inches, wherein the bottom surface 151 dimensions are approximately 2 to 4 inches less than the respective dimensions of the top surface 149. The baffle 110 has a thickness of from about 4 inches to about 12 inches, and a density of from about 5 denier to about 45 denier. Preferably the baffle 110 has a denier of 15 and is 5 to 6 inches thick. The baffle 110 is not attached to the mattress 102 and is porous such that water that fills the mattress 102 can travel through the baffle 110. However, the movement of the water through the baffle 110 is slowed as compared to movement of the water without the baffle 110. This helps prevent excessive undulation of the water in the mattress 102. Additional advantages of the baffle 110 include that it resists compression and melts when burned, as opposed to igniting and producing smoke, prevents abrupt bottoming out, reduces the possibility of shifting, and the waterbed system 100 as a whole is easier to assemble. Additionally, the baffle 110 is drainable, meaning, if a king size mattress 102 containing a baffle 110 is filled with approximately 150 gallons of water (equaling roughly 1245 pounds of water), and then said king size mattress 102 is drained according to the draining instructions provided with the system 100, the drained waterbed mattress 102 (with baffle 110 contained therein) will weigh approximately 60 to 70 pounds, which is the combined weight of any residual water plus the dry weight of the mattress 102 and baffle 110. In contrast, prior art baffle filled waterbed mattress typically weigh between about 100 and 200 pounds after standard draining procedures. When the mattress 102 is drained, the baffle 110 weighs less than the prior art foam baffles because it effects a more complete shedding of water. This makes the unfilled waterbed mattress 102 easier to move. Optionally, the system 100 comprises one or more baffles 110 within the mattress 102.

The cover 112 can comprise two separate layers, an upper layer 112A over the top surface 124 of the mattress 102 and around the outer surface 126 of the foam structure 104, and a lower layer 112B below the waterbed mattress 102, between the foundation cover 148 and the liner 114. The cover 112A and the lower layer of the cover 112B couple together by a zipper 150 along the periphery of the platform 106. The cover 112 is made from a woven or non-woven material and is elastic. For example, the cover 112 can be made from a combination of at least 70% polyester fiber and less than 20% synthetic fiber such as elastane. Preferably the cover 112 comprises no more than 95% polyester fiber and between about 5% to about 30% synthetic fiber. Examples of an acceptable synthetic fiber are sold under the tradenames Lycra® and Spandex® made by Invista, e having a place of business in Wichita, Kans. Optionally the cover 112 can be made from at least 70% polyester fiber and less than 30% of a combination of elastane and rayon. An acceptable rayon source is sold under the tradename Viscose® by Barnhardt Manufacturing Company, having a place of business in Charlotte, N.C. The cover 112 can be stretched at least 10%, and up to 40%, of its non-stretched state in one or both directions, and then recovers to its non-stretched state. The cover 112 is designed to be removable without draining the water mattress, and can be machine-washed or dry-cleaned, and re-attached to bed. The cover 112 can have its own attached layer of insulation material and can have a thickness including any attached insulating or other layers of less than 1 inch. Optionally the cover 112 can have a thickness less than 0.5 inches. This material that the cover 112 is made out of allows the user to experience a more comfortable and true floating sensation.

The lower layer of the cover 112B can comprise a single piece of material, or the lower layer 112B can comprise four separate pieces of material coupled together along mitered corners. In either instance, the lower layer 112B has an exterior periphery proximate the periphery of the platform 106 and an interior periphery forming an open center. Because the lower layer of the cover 112B extends along the periphery of the platform 106 and has an open center, the length of the lower layer 112B is the same as the length and/or width of the platform 106 being used, and the width of the lower layer 112B is from about 4 inches to about 12 inches wide. There is a plurality of grommets 152 disposed along the interior periphery of the lower layer of the cover 112B, spaced approximately ½ inch to 1 inch from the interior periphery.

The water proof liner 114 is below the bottom surface 122 of the mattress 102, around the periphery of the mattress 102, over the inner and upper surfaces 128, 130 of the foam structure 104, and around the outer surface 126 of the foam structure 104. The liner 114 extends from the outer surface 126 under the foam structure 104 approximately 3 inches. The liner 114 prevents any water that leaks from the mattress 102 from contacting either the foam structure 104 or the platform 106 beneath the mattress 102. The liner can be made of a material such as polyvinylchloride.

The waterbed heater 116 is on the upper surface 144 of the platform 106, between the liner 114 and the upper surface 144 of the platform 106. A temperature sensor is also located on the upper surface 144 of the platform 106, below the liner and the mattress. The heater 116 and the temperature sensor are each coupled to a heater controller (not shown) by their own respective cords which run through an opening located in the platform. The heater controller is located below the platform, coupled to the foundation, and allows the user to control the temperature of the heater, and also allows the heater to self-regulate based on the temperature readings received from the temperature sensor.

The layer of insulation 118 is attached to at least a portion of the lower surface 146 of the platform 106, but typically the insulation 118 is coupled to the substantially the entire lower surface 146. Alternatively, the insulation 118 can be on the upper surface 144 of the platform 106, or on both the upper and lower surfaces 144, 146 of the platform 106. Optionally the insulation 118 comprises a plurality of pieces of insulation 118 attached to the lower surface 146. The insulation 118 helps insulate the waterbed mattress 102 and reduces the amount of temperature fluctuation undergone by the waterbed mattress 102. The insulation 118 also helps the waterbed mattress 102 maintain a desired temperature (because heat loss is reduced) which in turn reduces the amount of power needed to run the heater 116, and also reduces operating costs. The insulation 118 can be from about 1 inch to about 7 inches thick, but preferably the insulation 118 is about 3 to 4 inches thick. Preferably the insulation 118 is fiberglass of the type used from home insulation. Optionally, the insulation 118 comprises a rigid foam.

Figure 3:
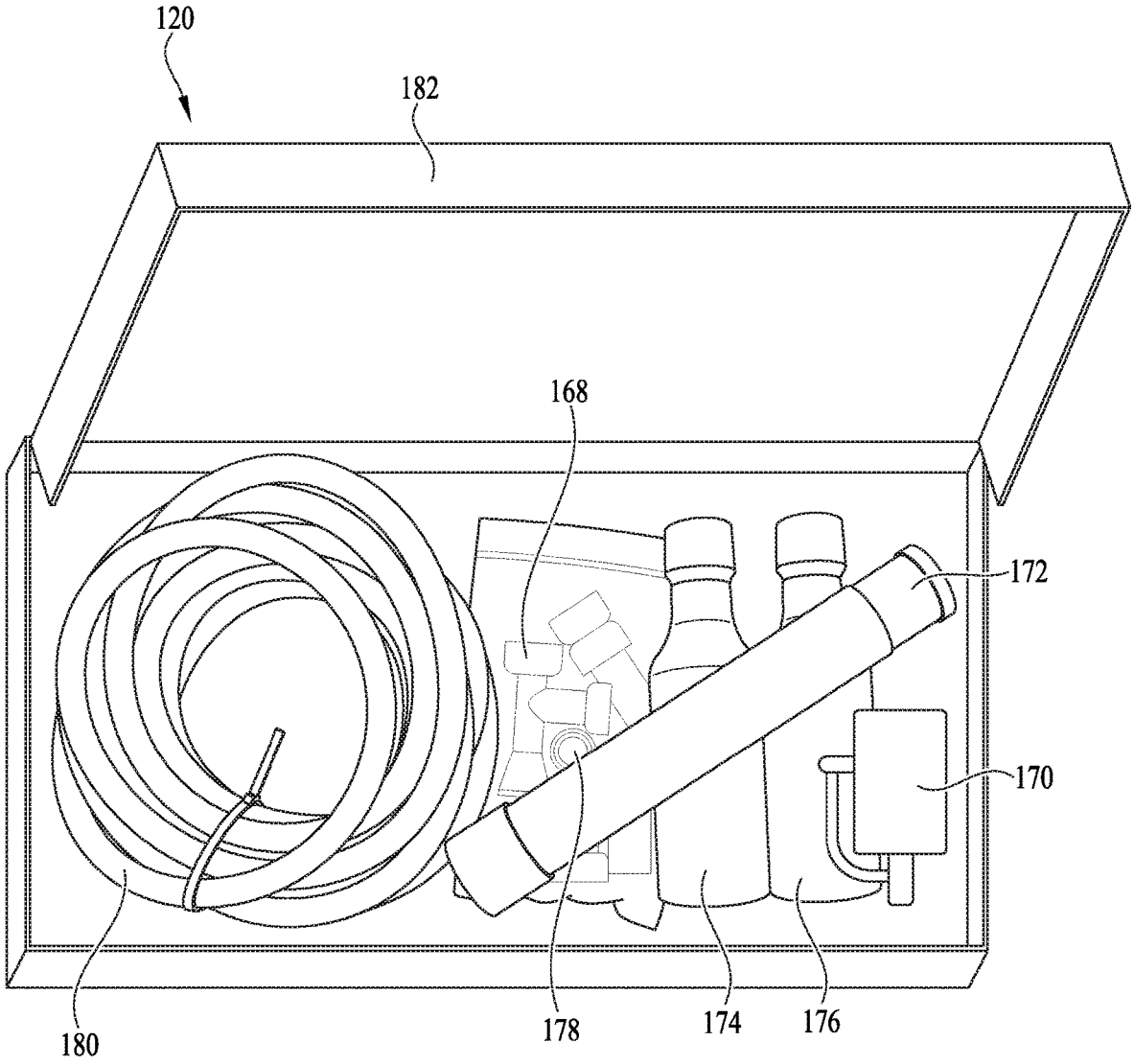
FIG. 3 is a perspective view of an accessory storage container having features of the present invention, wherein accessories are contained therein.

As shown in FIG. 2, the accessory storage container 120 is coupled to the foundation and optionally contains at least one accessory for use with the waterbed mattress 102. Waterbeds require several different accessories to facilitate filling, draining and maintaining the water enclosed therein. As shown in FIG. 3, the at least one accessory comprises one or more of a hose connector 168, a venturi pump 170 for draining the mattress 102, an air extractor 172, water conditioner 174, waterbed mattress surface cleaner 176, waterbed mattress valve caps 178 and at least one hose 180. Users typically store these accessories in a different location than which the waterbed system 100 is located, which over time means the accessories tend to get lost or misplaced. In order to combat this problem, the accessory storage container 120 is provided. It is either permanently or removable coupled to the inside of the foundation 108. In either version, the container 120 can have a door 182/openable and closable for access to the accessories or the container 120 can comprise an open top, such that once removed from the foundation 108, the accessories contained therein are viewable. If the accessory container 120 is removably coupled to the foundation 108, then preferably it is removably coupled so that it can be removed from the foundation 108 without tools, for example by hook and loop fasteners. The container 120 is from about 5 inches to about 10 inches tall, about 8 inches to about 20 inches long, and about 3 inches to about 6 inches wide.

The waterbed system 100 can have a layer of memory foam 154 between the top surface 124 of the waterbed mattress 102 and the cover 112A. Many users enjoy sleeping on memory foam but dislike the tendency for memory foam to retain heat. Placing the layer of memory foam 154 on top of the waterbed mattress 102 allows the waterbed mattress 102 to act as a heat sink. And due to the fact that that the temperature of the waterbed mattress 102 can be controlled by the user via the heater pad 116 and heater pad controller, the user can adjust the temperature of the waterbed mattress 102 so that the memory foam 154 doesn't retain too much heat. The memory foam 154 can comprise a single piece, or more than one piece disposed side by side across the top of the mattress 102. In either event, the thickness of the memory foam 154 can be from about ½ inch to about 3 inches, but preferably the memory foam 154 is 1 inch thick. The memory foam 154 can also have a cover 164, preferably made from a knitted fabric comprised of modacrylic, fiberglass, and polyester, sold under the trade name Integrity30® by Ventex, having a place of business in Ashburn, Va.

The waterbed system 100 can further comprise a plurality of fasteners 156. The fasteners 156 are typically bolts that are inserted through the slat 142 (and consequently the flap 136 of the foam cover 134 disposed immediately below the slat 142), through the grommets 152 in the lower layer of the cover 112B, and into female receptacles 158 in the platform 106. This secures both the foam structure 104, and the lower layer of the cover 112B, to the platform 106.

Optionally, the foundation 108 of the waterbed system 100 sits upon a metal bed frame 160, and the metal bed frame 160 can have a plurality of feet 162.

Figure 4:
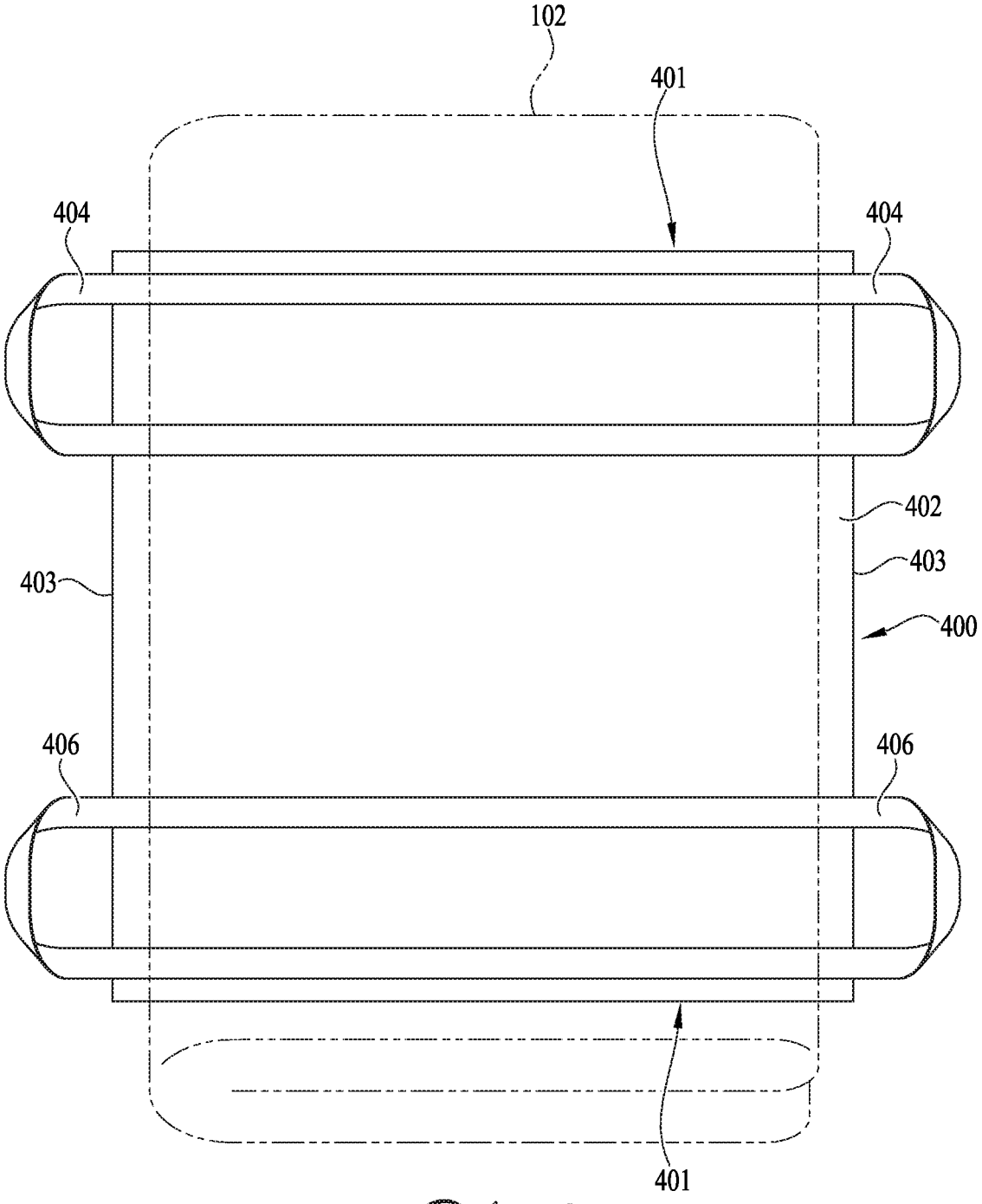
FIG. 4 is a top plan view of a carrier for the waterbed mattress of the system of FIG. 1, with the waterbed mattress shown in phantom thereon.

Optionally, as shown in FIG. 4, the invention is a carrier 400 for a waterbed mattress 102 comprising a sheet of flexible material 402 and a first and a second set of handles 404, 406. The sheet of flexible material 402 has a longitudinal axis, opposed end edges 401 and opposed side edges 403. The sheet of flexible material 402 has a maximum length of from about 30 inches to about 50 inches, and a maximum width of from about 30 inches to about 50 inches. Preferably, the sheet of flexible material 402 is about 35 inches side and 39 inches long.

The first set of handles 404 is attached to the flexible material 402 and comprises a handle extending from each of the side edges 403 and opposed to each other. The second set of handles 406 is attached to the flexible material 402 and comprises a handle extending from each of the side edges 403 and opposed to each other. The first set of handles 404 and the second set of handles 406 are laterally spaced apart from each other.

In use, an unfilled waterbed mattress 102 is folded and placed on the carrier, and the first and second sets of handles 404, 406 permit either two or four people to lift the carrier 400 and mattress 102 contained thereon.

The invention also comprises a method for moving a waterbed mattress 102, the method comprising the steps of i) draining substantially all water contained in the waterbed mattress 102 from the waterbed mattress 102, ii) folding the drained waterbed mattress 102, iii) placing the folded waterbed mattress 102 on a carrier 400 for a waterbed mattress 102, and iv) moving the carrier 400 and the folded waterbed mattress 102 contained therein.

Various versions of the present invention have one or more of the following advantages compared to conventional waterbed systems:

1) Insulation below the platform provides energy efficiency;

2) The combination of comfort provided memory foam without excessive heat discomfort due to the waterbed mattress serving as a heat sink;

3) Accessories do not get misplaced and are readily available;

4) Baffle that lets water drain so the mattress can be moved with less effort than with a baffle that absorbs water or is difficult to drain;

5) Baffle's ability to drain means it weighs less when drained, which makes the drained waterbed mattress easier to move;

6) Baffle does not ignite, but rather melts, providing an added safety feature;

7) Baffle prevents abrupt bottoming out, reduces the possibility of shifting, and the waterbed system 100 as a whole is easier to assemble;

8) Sheets can be secured in place;

9) An integrated system whose components work well with each other;

10) The platform protects the insulation from being compressed and losing its insulation properties because the insulation is not subject to the compressive forces of the waterbed mattress;

11) No one has provided all the necessary waterbed components as a kit—the current invention provides an integrated kit with assembly instructions and number parts so that they can easily be assembled in order, by the customer themselves. The locations of the heater control are set and the customers are informed of where all the parts need to go. In the past, a large amount of the waterbed components were made by different manufacturers, and the retailer was left to assemble the bed in the customers home. The components may not fit right, and in the event a customer would like to disassemble and move the bed, they have no idea how to reassemble it because they may not have originally assembled the waterbed, or it may have been a couple years since the assembly and no comprehensive assembly instructions were provided therewith; and 12) The stretchable cover provides added comfort because it can more completely conform to whatever shape the mattress takes when a user is lying on it.

Although the invention has been described in terms of a preferred embodiment, nevertheless, changes and modifications can be made which do not depart from the spirit, scope and teachings of the invention. Such changes and modifications are deemed to fall within the purview of the present invention as claimed.

What is claimed is:

1. A waterbed system for placement on a ground surface, the waterbed system comprising:

a) a waterbed mattress having a periphery, a bottom surface, a top surface, a top surface length of from about 80 inches to about 90 inches, a top surface width of from about 30 inches to about 80 inches, and when filled with water a height of from about 6 inches to about 10 inches;

b) a foam structure around the periphery of the mattress, the foam structure having an outer surface, an inwardly sloping inner surface, a top surface, and a bottom surface, wherein the inwardly sloping inner surface and the bottom surface meet at an inner corner, and the top surface of the foam structure be substantially flush with the top surface of the mattress when the mattress is filled with water;

c) a water vapor permeable cover made of flashspun high-density polyethylene fibers for the foam structure, the water vapor permeable cover having a flap extending from the inner corner formed by the inner and bottom surfaces of the foam structure, the flap having a length, a proximal edge proximate the inner corner of the foam structure and a distal portion;

d) a platform below the mattress and the foam structure periphery for supporting the waterbed mattress and the foam structure, the platform having an upper surface, a lower surface and an upper surface periphery;

e) at least one retainer configured to retain the distal portion of the flap on the platform;

f) a cover comprising:

i) an upper layer over the top surface of the mattress and around the outer surface of the foam structure; and ii) a lower layer below the waterbed mattress, the lower layer having an exterior periphery proximate the upper surface periphery of the platform and an interior periphery forming an open center;

wherein the upper layer and the lower layer are removably coupled to each other by a zipper that extends along the upper surface periphery of the platform;

g) a water proof liner for placement below the bottom surface of the mattress, around the periphery of the mattress, over the inner and upper surfaces of the foam structure, and around the outer surface of the foam structure;

h) a waterbed heater for placement between the liner and the upper surface of the platform; and i) waterbed heater controller electrically coupled to the waterbed heater for controlling the waterbed heater.

2. The system of claim 1, wherein the cover can be stretched in at least one direction by at least 10% and no more than 40%.

3. The system of claim 1, wherein the cover is made from at least 70% polyester fiber and between about 5% and 30% synthetic fiber.

4. The system of claim 1, wherein the retainer is a slat extending the full length of the flap.

5. The system of claim 1, wherein the flap is isosceles trapezoid shaped.

6. The system of claim 1, wherein the retainer is a slat coupled to the platform by a plurality of fasteners.

7. The system of claim 6 wherein the fasteners are bolts.

8. The system of claim 1, further comprising a plurality of grommets disposed along the interior periphery of the lower layer of the cover.

* * * * *